US007625847B2

(12) United States Patent
Yagishita

(10) Patent No.: US 7,625,847 B2
(45) Date of Patent: Dec. 1, 2009

(54) LUBRICATING OIL COMPOSITIONS

(75) Inventor: Kazuhiro Yagishita, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 352 days.

(21) Appl. No.: 11/048,573

(22) Filed: Feb. 1, 2005

(65) Prior Publication Data

US 2005/0130855 A1 Jun. 16, 2005

Related U.S. Application Data

(63) Continuation of application No. PCT/JP03/09883, filed on Aug. 4, 2003.

(30) Foreign Application Priority Data

Aug. 5, 2002 (JP) ..... 2002-227455
Aug. 5, 2002 (JP) ..... 2002-227456
Aug. 5, 2002 (JP) ..... 2002-227457
Aug. 5, 2002 (JP) ..... 2002-227458

(51) Int. Cl.
*C10M 137/06* (2006.01)
*C10M 129/54* (2006.01)

(52) U.S. Cl. ..... 508/440; 508/460

(58) Field of Classification Search ..... 508/175, 508/440, 460
See application file for complete search history.

(56) References Cited

U.S. PATENT DOCUMENTS

| | | | | | |
|---|---|---|---|---|---|
| 3,912,639 | A | * | 10/1975 | Adams | 508/159 |
| 4,612,129 | A | | 9/1986 | DiBiase et al. | |
| 5,380,508 | A | * | 1/1995 | Inoue | 423/286 |
| 5,415,792 | A | * | 5/1995 | Campbell | 508/459 |
| 5,415,793 | A | * | 5/1995 | Nassry et al. | 508/377 |
| 5,498,809 | A | * | 3/1996 | Emert et al. | 585/13 |
| 5,567,342 | A | * | 10/1996 | Inoue et al. | 508/287 |
| 5,652,201 | A | * | 7/1997 | Papay et al. | 508/228 |
| 5,670,464 | A | * | 9/1997 | Kita et al. | 508/562 |
| 6,159,911 | A | * | 12/2000 | Katafuchi | 508/391 |
| 2002/0142922 | A1 | * | 10/2002 | Yagishita et al. | 508/374 |

FOREIGN PATENT DOCUMENTS

| | | | |
|---|---|---|---|
| EP | 0 234 923 | A2 | 9/1987 |
| EP | 0 243 026 | A2 | 10/1987 |
| EP | 0 280 579 | A2 | 8/1988 |
| EP | 0 280 580 | A2 | 8/1988 |
| EP | 1 203 804 | A1 | 5/2002 |
| EP | 1 227 145 | A1 | 7/2002 |
| EP | 1 338 643 | A1 | 8/2003 |
| GB | 1146925 | | 3/1969 |
| GB | 1184020 | | 3/1970 |
| JP | 48-35325 | B | 10/1973 |
| JP | 50-003082 | B | 1/1975 |
| JP | 52-000704 | A | 1/1977 |
| JP | 62-501572 | A | 6/1987 |
| JP | 62-501917 | A | 7/1987 |
| JP | 62-243692 | A | 10/1987 |
| JP | 62-253691 | A | 11/1987 |
| JP | 63-304095 | A | 12/1988 |
| JP | 63-304096 | A | 12/1988 |
| JP | 1-500912 | A | 3/1989 |
| JP | 06-041568 | A | 2/1994 |
| JP | 08-048989 | A | 2/1996 |
| JP | 08-253782 | A | 10/1996 |
| JP | 09-111275 | A | 4/1997 |
| JP | 11-302679 | A | 11/1999 |
| JP | 2000-063862 | A | 2/2000 |
| JP | 2000-256690 | A | 9/2000 |
| JP | 2002-212579 | A | 7/2002 |
| JP | 2002-294271 | A | 10/2002 |
| JP | 2003-183686 | A | 7/2003 |
| JP | 2003-277781 | A | 10/2003 |
| JP | 2003-277782 | A | 10/2003 |
| JP | 2003-277783 | A | 10/2003 |
| JP | 2004-035619 | A | 2/2004 |
| JP | 2004-035620 | A | 2/2004 |
| JP | 2004-083891 | A | 3/2004 |
| WO | WO 86-06739 | A1 | 11/1986 |
| WO | WO 88/02771 | A1 | 4/1988 |
| WO | WO 94/28094 | A1 | 12/1994 |
| WO | WO 2004/003118 | A1 | 1/2004 |

* cited by examiner

*Primary Examiner*—Glenn Caldarola
*Assistant Examiner*—Jim Goloboy
(74) *Attorney, Agent, or Firm*—Panitch Schwarze Belisario & Nadel LLP

(57) ABSTRACT

Disclosed are lubricating oil compositions comprising a lubricating base oil, (A) a specific alkali metal or alkaline earth metal salicylate and/or an overbased or basic salt thereof in an amount of 0.005 to 5 percent by mass in terms of metal and (B) a phosphorus-containing anti-wear agent in an amount of 0.005 to 0.2 percent by mass in terms of phosphorus and containing sulfur in an amount of 0.3 percent by mass or less, based on the total mass of the composition, the salicylate being any of salicylates fulfilling specific requirements. The lubricating oil compositions are low sulfur lubricating oils which are extremely excellent in anti-wear properties and long drain properties and suitable for an internal combustion engine.

8 Claims, No Drawings

LUBRICATING OIL COMPOSITIONS

CROSS-REFERENCE TO RELATED APPLICATION

This application is a continuation of International Application No. PCT/JP03109883, filed Aug. 4, 2003, which was published in the Japanese language on Feb. 12. 2004, under International Publication No. WO 2004/013264 A1, the disclosure of which is incorporated herein by reference.

FIELD OF THE INVENTION

The present invention relates to low sulfur lubricating oil compositions and more particularly to those with excellent anti-wear properties and long drain properties, suitable for internal combustion engines.

BACKGROUND OF THE INVENTION

Sulfur- and phosphorus-containing additives such as zinc dialkyldithiophosphates, with excellent anti-wear and anti-oxidation properties have been used as substantially essential additives for conventional lubricating oils, particularly those for internal combustion engines. However, the lubricating oils have been required to contain more less sulfur, phosphorus and ash as a result of necessity to alleviate harmful influences on exhaust-gas purifying catalysts such as ternary catalysts, oxidation catalysts and NOx adsorbers, or exhaust-gas after-treatment devices such as diesel particulate filters (DPF), which are equipped in internal combustion engines in conformity with recent environment-related issues.

Examples of low phosphorus or phosphorus free oils which have been disclosed so far include those described in Japanese Patent Laid-Open Publication Nos. 62-253691, 1-500912, 6-41568, 63-304095, 63-304096, 52-704, 62-243692, 62-501917, 62-501572, and 2000-63862. Examples of low ash oils include those described in Japanese Patent Laid-Open Publication Nos. 8-48989, 8-253782, 9-111275, and 2000-256690. However, when these known oils contain decreased or no zinc dithiophosphate, they need to be blended with a sulfur-containing compound for maintaining their anti-wear properties, while the low ash oils contain zinc dithiophosphate necessarily. So far there have been discovered few lubricating oils having excellent anti-wear properties and decreased in sulfur, phosphorus, and ash contents.

The present inventor found that low sulfur lubricating oil compositions containing a phosphorus-containing compound such as zinc mono- or di-alkylphosphtes, zinc dialkylmonothiophosphates or phosphoric acid triesters exhibited more excellent low friction properties, high temperature detergency, oxidation stability, and base number retention properties while maintaining anti-wear properties, than those containing zinc dithiophosphate only and have filed patent applications for such low sulfur lubricating oil compositions (Japanese Patent Application Nos. 2002-015351, 2001-315941, 2002-086145, 2002-086146, 2002-086147, 2002-191090, 2002-191091, and 2002-191092). However, in the case of using a salicylate-based detergent whose metal ratio is 5 or less, particularly that whose metal ratio is adjusted to be 3 or less, as a metallic detergent, a composition can be obtained which is extremely excellent in low friction properties, high temperature detergency, oxidation stability, and base number retention properties. However, it was found out that when the content of a sulfur- and phosphorus-containing anti-wear agent such as zinc dithiophosphate is decreased or a sulfur-free phosphorus-containing anti-wear agent is used, for decreasing the sulfur content, the resulting composition would not be able to exhibit sufficiently anti-wear properties for the valve train of an internal combustion engine, such as anti-scuffing properties for rocker arms and anti-wear properties for cams.

The present invention was made in view of the foregoing circumstances and intends to provide a long drain type low sulfur lubricating oil composition containing a salicylate-based detergent and having excellent anti-wear properties.

BRIEF SUMMARY OF THE INVENTION

As a result of extensive studies, the present invention was achieved by finding that a low sulfur and phosphorus lubricating oil composition containing a specific salicylate-based detergent and a phosphorus-containing anti-wear agent was able to solve the above-mentioned problems.

That is, the present invention relates to a lubricating oil composition comprising a lubricating base oil, (A) an alkali metal or alkaline earth metal salicylate represented by formula (1) below and/or an overbased or basic salt thereof in an amount of 0.005 to 5 percent by mass in terms of metal and (B) a phosphorus-containing anti-wear agent in an amount of 0.005 to 0.2 percent by mass in terms of phosphorus and containing sulfur in a total amount of 0.3 percent by mass or less, based on the total mass of the composition, the salicylate being any of salicylates fulfilling at least one of requirements selected from (I) through (IV) or a mixture of the salicylates:

(1)

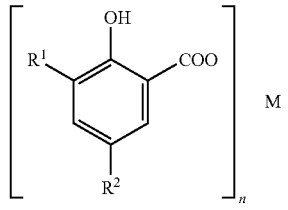

wherein $R^1$ is a hydrocarbon group having 1 to 40 carbon atoms, $R^2$ is hydrogen or a hydrocarbon group having 1 to 40 carbon atoms, which hydrocarbon groups may contain oxygen or nitrogen, M is an alkali metal or alkaline earth metal, and n is an integer of 1 or 2 depending on the valence of the metal;

(I) either one of $R^1$ or $R^2$ in formula (1) is a hydrocarbon group having 1 to 9 carbon atoms and the other is a hydrocarbon group having 10 to 40 carbon atoms, and the difference of carbon number between $R^1$ and $R^2$ is 10 or more;

(II) the component ratio of a salicylate represented by formula (1) wherein $R^1$ and $R^2$ are hydrocarbon groups having 10 to 40 carbon atoms is adjusted to be 10 percent by mol or more;

(III) the component ratio of a salicylate having one hydrocarbon group having 20 to 40 carbon atoms is 85 percent by mol or more wherein the component ratio of a salicylate represented by formula (1) wherein $R^1$ is a hydrocarbon group having 20 to 40 carbon atoms and R2 is hydrogen is adjusted to be 40 percent by mol or more; and (IV) the component ratio of a salicylate having one hydrocarbon group having 10 to 19 carbon atoms is 85 percent by mol or more wherein the component ratio of a salicylate represented by formula (1) wherein $R^1$ is a hydrocarbon group having 10 to 19 carbon atoms and $R^2$ is hydrogen is adjusted to be 55 percent by mol or more.

In the present invention, Component (B) is at least one type of compound selected from the group consisting of phosphorus compounds represented by formulas (2) and (3), and metal salts and amine salts thereof:

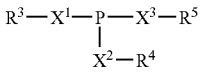

(2)

wherein $X^1$, $X^2$, and $X^3$ are each independently oxygen or sulfur, and $R^3$, $R^4$, and $R^5$ are each independently hydrogen or a hydrocarbon group having 1 to 30 carbon atoms; and

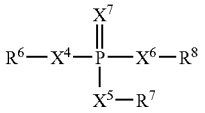

(3)

wherein $X^4$, $X^5$, $X^6$, and $X^7$ are each independently oxygen or sulfur, and $R^6$, $R^7$, and $R^8$ are each independently hydrogen or a hydrocarbon group having 1 to 30 carbon atoms.

Component (B) is preferably at least one type of compound selected from the group consisting of metal salts of phosphorus compounds of formula (2) wherein all of $X^1$, $X^2$, and $X^3$ are oxygen and of formula (3) wherein all of $X^4$, $X^5$, $X^6$, and $X^7$ are oxygen.

Component (B) is preferably a phosphorus compound of formula (3) wherein all of $X^4$, $X^5$, $X^6$, and $X^7$ are oxygen, and $R^6$, $R^7$, and $R^8$ are each independently a hydrocarbon group having 1 to 30 carbon atoms.

Component (B) is preferably a zinc salt of a phosphorus compound of formula (3) wherein any two of $X^4$, $X^5$, $X^6$, and $X^7$ are oxygen.

The lubricating oil composition of the present invention contains Component (B) in an amount of preferably 0.08 percent by mass or less in terms of phosphorus based on the total mass of the composition.

The lubricating oil composition of the present invention contains preferably at least one type of additive selected from the group consisting of (C) ashless dispersants and (D) antioxidants.

The total sulfur content of the lubricating base oil is preferably 0.05 percent by mass or less.

The lubricating oil composition is used for an internal combustion engine.

The sulfated ash content of the lubricating oil composition for an internal combustion engine is preferably 1.0 percent by mass or less.

The lubricating oil composition for an internal combustion engine preferably fulfills one or more requirements selected from those wherein the sulfated ash content is 0.5 percent by mass or less, the total sulfur content is 0. 05 percent by mass or less, and the phosphorus content is 0.05 percent by mass or less.

The present invention also relates to a method for preventing the valve train of an internal combustion engine from wearing using the lubricating oil composition.

DETAILED DESCRIPTION OF THE INVENTION

The lubricating oil composition will be described in more detail below.

No particular limitation is imposed on lubricating base oils used in the present invention. Therefore, any conventional mineral and synthetic base oils used for lubricating oils may be used.

Specific examples of mineral base oils include those which can be obtained by subjecting a lubricating oil fraction produced by vacuum-distilling a topped crude resulting from atmospheric distillation of a crude oil, to any one or more treatments selected from solvent deasphalting, solvent extraction, hydrocracking, solvent dewaxing, and hydrorefining; wax-isomerized mineral oils; and those obtained by isomerizing GTL WAX (Gas to Liquid Wax).

No particular limitation is imposed on the sulfur content of mineral base oils as long as the total sulfur content of the composition is 0.3 percent by mass or less. The sulfur content of mineral oils is preferably 0.05 percent by mass or less, more preferably 0.01 percent by mass or less, and particularly preferably 0.005 percent by mass or less. A lubricating oil composition with more excellent long drain properties can be obtained by decreasing the sulfur content of a mineral base oil. When such a lubricating oil composition is used for an internal combustion engine, it can avoid harmful influences on exhaust-gas after treatment devices as much as possible.

Although no particular limitation is imposed on the total aromatic content of mineral base oils, it is preferably 10 percent by mass or less, more preferably 6 percent by mass or less, further more preferably 3 percent by mass or less, and particularly preferably 2 percent by mass or less. A lubricating oil composition with more excellent oxidation stability can be obtained by decreasing the total aromatic content of a base oil to 10 percent by mass or less.

The term "total aromatic content" used herein denotes an aromatic fraction content determined in accordance with ASTM D2549. The aromatic fraction includes alkylbenzenes; alkylnaphthalens; anthracene, phenanthrene, and alkylated products thereof; compounds wherein four or more benzene rings are condensated to each other; and compounds having heteroaromatics such as pyridines, quinolines, phenols, and naphthols.

Specific examples of synthetic base oils include polybutenes and hydrides thereof; poly-α-olefins such as 1-octene oligomer and 1-decene oligomer, and hydrides thereof; diesters such as ditridecyl glutarate, di-2-ethylhexyl adipate, diisodecyl adipate, ditridecyl adipate, and di-2-ethylhexyl cebacate; polyol esters such as neopentyl glycol ester, trimethylolpropane caprylate, trimethylolpropane pelargonate, pentaerythritol-2-ethyl hexanoate, and pentaerythritol pelargonate; aromatic synthetic oils such as alkylnaphthalenes, alkylbenzenes, and aromatic esters; and mixtures thereof.

Any one of the above-described mineral base oils or synthetic base oils or any mixture of two or more types selected from these base oils may be used in the present invention. For example, the base oil used in the present invention may be one or more of the mineral base oils or synthetic base oils or a mixed oil of one or more of the mineral base oils and one or more of the synthetic base oils.

Although no particular limitation is imposed on the kinematic viscosity at 100° C. of the lubricating base oil used in the present invention, it is preferably 20 $mm^2/s$ or lower, more preferably 10 $mm^2/s$ or lower, and preferably $mm^2/s$ or higher, more preferably2 $mm^2/s$ or higher. A lubricating base oil with a kinematic viscosity at 100° C. exceeding 20 $mm^2/s$ is not preferred because the low temperature viscosity characteristics of the resulting lubricating oil composition would be deteriorated, while that with a kinematic viscosity at 100° C. of less than 1 $mm^2/s$ is not also preferred because the resulting lubricating oil composition would be poor in lubricity due to its insufficient oil film formation capability at lubricated sites and large in evaporation loss of the base oil.

The evaporation loss of the base oil used in the present invention is preferably 20 percent by mass or less, more preferably 16 percent by mass or less, and particularly preferably 10 percent by mass or less, as measured by NOACK evaporation analysis. A lubricating base oil with a NOACK evaporation loss exceeding 20 percent by mass is not preferred because the resulting lubricating oil composition would be large in evaporation loss of the base oil and the sulfur compounds, phosphorus compounds or metals in the composition would accumulate on an exhaust gas purifying device together with the base oil if the composition is used as an internal combustion engine lubricating oil and thus would adversely affect the exhaust gas purifying performance. The term "NOACK evaporation" used herein is defined as the amount of a sample lubricating oil of 60 g, which is lost when the oil is retained at a temperature of 250° C. and a pressure of 20 $mmH_2O$ (196 Pa) for one hour in accordance with ASTM D 5800.

Although no particular limitation is imposed on the viscosity index of the lubricating base oil used, it is preferably 80 or higher, more preferably 100 or higher, and further more preferably 120 or higher so as to be able to obtain excellent viscosity characteristics ranging from low temperatures to high temperatures. A lubricating base oil with a viscosity index of less than 80 is not preferred because the low temperature viscosity characteristics of the resulting lubricating oil composition would be deteriorated.

Components (A) of the lubricating oil composition of the present invention are one or more compounds selected from the group consisting of alkali metal and alkaline earth metal salicylates represented by formula (1) and overbased or basic salts thereof:

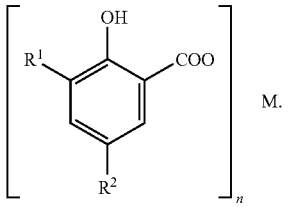

(1)

In formula (1), $R^1$ is a hydrocarbon group having 1 to 40 carbon atoms, R2 is hydrogen or a hydrocarbon group having 1 to 40 carbon atoms, which hydrocarbons may contain oxygen or nitrogen, M is an alkali metal such as sodium and potassium or an alkaline earth metal such as magnesium, barium, and calcium and particularly preferably magnesium and calcium, and n is an integer of 1 or 2 depending on the valence of the metal.

Examples of the hydrocarbon group having 1 to 40 carbon atoms include alkyl, cycloalkyl, alkenyl, alkyl-substitutedcycloalkyl, aryl, alkyl-substituted aryl, and arylalkyl groups. More specific examples include straight-chain or branched alkyl groups having 1 to 40 carbon atoms, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups; cycloalkyl groups having 5 to 7 carbon atoms, such as cyclopentyl, cyclohexyl, and cycloheptyl groups; alkylcycloalkyl groups having 6 to 10 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, and methylethylcycloheptyl groups, of which the alkyl groups may bond to any position of the cycloalkyl groups; straight-chain or branched alkenyl groups such as butenyl, pentenyl, hexenyl, heptenyl, octenyl, noneyl, decenyl, undecenyl, dodecenyl, tridecenyl, tetradecenyl, pentadecenyl, hexadecenyl, heptadecenyl, octadecenyl and nonadecenyl groups, the position of which the double bonds may vary; aryl groups such as phenyl and naphtyl groups; alkylaryl groups having 7 to 10 carbon atoms, such as tolyl, xylyl, ethylphenyl, propylphenyl, and butylphenyl groups, of which the alkyl groups may be straight-chain or branched and may bond to any position of the aryl groups; and arylalkyl groups having 7 to 10 carbon atoms, such as benzyl, phenylethyl, phenylpropyl, and phenylbutyl groups, of which the alkyl groups may be straight-chain or branched.

In the present invention, Component (A) necessarily fulfills at least one requirement selected from the group consisting of the following requirements (I) through (IV) and may be a mixture of salicylates each fulfilling these requirements wherein:

(I) either one of $R^1$ or $R^2$ in formula (1) is a hydrocarbon group having 1 to 9 carbon atoms and the other is a hydrocarbon group having 10 to 40 carbon atoms, and the difference of carbon number between $R^1$ and $R^2$ is 10 or more;

(II) the component ratio of a salicylate represented by formula (1) wherein $R^1$ and $R^2$ are hydrocarbon groups having 10 to 40 carbon atoms is adjusted to be 10 percent by mol or more;

(III) the component ratio of a salicylate having one hydrocarbon group having 20 to 40 carbon atoms is 85 percent by mol or more wherein the component ratio of a salicylate represented by formula (1) wherein $R^1$ is a hydrocarbon having 20 to 40 carbon atoms and $R^2$ is hydrogen is adjusted to be 40 percent by mol or more; and (IV) the component ratio of a salicylate having one hydrocarbon group having 10 to 19 carbon atoms is 85 percent by mol or more wherein the component ratio of a salicylate represented by formula (1) wherein $R^1$ is a hydrocarbon group having 10 to 19 carbon atoms, and $R^2$ is hydrogen is adjusted to be 55 percent by mol or more.

In requirement (I), either one of $R^1$ or $R^2$ is a hydrocarbon group having 1 to 9 carbon atoms, preferably 1 to 5 carbon atoms, and particularly preferably one carbon atom, and the other is a hydrocarbon group having 10 to 40 carbon atoms, preferably a secondary alkyl group having 10 to 30 carbon atoms, more preferably a secondary alkyl group having 20 to 30 carbon atoms with the objective of extremely excellent anti-wear properties for cams and a secondary alkyl group having 10 to 19 carbon atoms with the objective of less influence of water to the anti-oxidation properties of the resulting lubricating oil composition, and particularly preferably a secondary alkyl group having 14 to 18 carbon atoms. The difference of carbon number between $R^1$ and $R^2$ is necessarily 10 or more.

Specifically, the secondary alkyl group is preferably a secondary alkyl group having 10 to 40 carbon atoms, derived from polymers or copolymers of ethylene, propylene, or butylene.

Examples of the hydrocarbon group having 1 to 9 carbon atoms include alkyl group having 1 to 9 carbon atoms, such as methyl, ethyl, butyl, and t-butyl groups which may contain oxygen or nitrogen, for example -COOH. Preferred are t-butyl and methyl groups, and most preferred is a methyl group.

Salicylates fulfilling requirement (I) are unobtainable because they are not commercially available now but can be obtained using any of known methods such as those disclosed in Japanese Patent Publication Nos. 48-35325 and 50-3082. More specifically, first of all, an alkylsalicylic acid wherein either one of $R^1$ or $R^2$ is an alkyl group having 10 to 40 carbon atoms, and the other is an alkyl group having 1 to 9 carbon atoms is obtained by a method wherein the starting material such as orthocresol or paracresol, or ortho-t-butylphenol or para-t-butylphenol is alkylated selectively at the para- or ortho-position using an olefin having 10 to 40 carbon atoms and preferably 14 to 19 or 20 to 30 carbon atoms so as to obtain 3-methyl-5-alkylphenol or 3-alkyl-5-methylphenol, or 3-t-butyl-5-alkylphenol or 3-alkyl-5-t-butylphenol, which is then carboxylated using carbon dioxide gas; or alternatively a method wherein the above starting material is carboxylated and then alkylated. Thereafter, the alkylsalicylic acid is reacted with a metal base such as an alkali metal or alkaline earth metal oxide or hydroxide or converted to an alkali metal salt such as sodium and potassium salts, which alkali metal salt may be further substituted with an alkaline earth metal salt thereby obtaining a salicylate fulfilling requirement (I).

In requirement (II), the component ratio of a salicylate of formula (1) wherein $R^1$ and $R^2$ are hydrocarbon groups having 10 to 40 carbon atoms is necessarily adjusted to be 10 percent by mol or more. $R^1$ or $R^2$ is preferably a secondary alkyl group having 10 to 40 carbon atoms, more preferably a secondary alkyl group having 10 to 19 or 20 to 30 carbon atoms, and particularly preferably a secondary alkyl group having 14 to 18 carbon atoms with the objective of less influence of water to the anti-oxidation properties of the resulting lubricating oil composition. $R^1$ and $R^2$ are desirously the same.

The secondary alkyl group is preferably a secondary alkyl group having 10 to 40 carbon atoms, derived from polymers or copolymers of ethylene, propylene, or butylene.

Salicylates fulfilling requirement (II) are unobtainable because they are not commercially available now but can be obtained using any of known methods such as those disclosed in Japanese Patent Publication Nos. 48-35325 and 50-3082. For example, 3,5-dialkylsalicylic acid the component ratio of which is 10 percent by mol or more, preferably 15 percent by mol or more, more preferably 20 percent by mol or more, even more preferably 40 percent by mol or more, and particularly preferably 100 percent by mol is reacted with a metal base such as an alkali metal or alkaline earth metal oxide or hydroxide or converted to an alkali metal salt such as sodium salt or potassium salt which alkali metal salt may further be substituted with an alkaline earth metal salt, thereby obtaining a salicylate fulfilling requirement (II).

No particular limitation is imposed on the method for producing the above-described 3,5-dialkylsalicylic acid. For example, the 3,5-dialkylsalicylic acid may be obtained by a method wherein 1 mol of a phenol as the starting material is alkylated using 1.1 to 4, preferably 2 to 4 mols, and particularly preferably 2 to 3 mols of an olefin having 10 to 40, and preferably 10 to 19 or 20 to 30 carbon atoms and then carboxylated using carbon dioxide gas or a method wherein 1 mol of salicylic acid is alkylated using 1.1 to 4 mols, preferably 2 to 4 mols, and particularly preferably 2 to 3 mols of the above olefin.

Alternatively, the 3,5-dialkylsalicylic acid may be obtained by selectively isolating or concentrating a small amount (usually less than 10 percent by mol) of a 3,5-dialkylsalicylate contained as a by-product in a commercially available neutral salicylate containing monoalkylsalicylate as the main component, so as to enhance the component ratio of the 3,5-dialkylsalicylate.

In requirement (III), it is necessary that the component ratio of a salicylate having one hydrocarbon group having 20 to 40 carbon atoms is 85 percent by mol or more wherein the component ratio of a salicylate represented by formula (1) wherein $R^1$ is a hydrocarbon group having 20 to 40 carbon atoms and $R^2$ is hydrogen is adjusted to be 40 percent by mol or more.

Examples of the hydrocarbon group having 20 to 40 carbon atoms include alkyl and alkenyl groups. More specifically, examples of the alkyl group include straight-chain or branched alkyl groups such as eicosyl, heneicosyl, docosyl, tricosyl, tetracosyl, pentacosyl, hexacosyl, heptacosyl, octacosyl, nonacosyl, and triacontyl groups, and examples of the alkenyl group include straight-chain or branched alkenyl groups such as eicosenyl, heneicosenyl, docosenyl, tricosenyl, tetracosenyl, pentacosenyl, hexacosenyl, heptacosenyl, octacosenyl, nonacosenyl, and triacontenyl groups, the position of which double bond may vary. Among these, particularly preferred are alkyl and alkenyl groups having 20 to 30 carbon atoms, among which preferred are secondary alkyl groups derived from polymers or copolymers of ethylene, propylene or butylene.

No particular limitation is imposed on the method for producing a salicylate fulfilling requirement (III). Any of known methods for producing monoalkylsalicylates may be used. For example, a phenol as the starting material is alkylated using the equivalent amount of an olefin having 20 to 40 carbon atoms and then carboxylated using carbon dioxide gas thereby obtaining a monoalkylsalicylic acid. Alternatively, salicylic acid as the starting material is alkylated using the equivalent amount of the olefin obtaining a monoalkylsalicylic acid. The resulting monoalkylsalicylic acid is reacted with a metal base such as an alkali metal or alkaline earth metal oxide or hydroxide or is substituted with an alkaline earth metal salt after being converted to an alkali metal salt such as sodium salt and potassium salt thereby obtaining a salicylate fulfilling requirement (III) The resulting salicylate is comprised of 85 percent by mol or more and preferably 90 percent by mol or more and 96 percent by mol or less of monoalkylsalicylate. However, if necessary, the purity of the monoalkylsalicylate may be increased to 100 percent by mol by isolating and removing the by-produced dialkylsalicylate.

It is necessary that the component ratio of a salicylate of formula (1) wherein $R^1$ is a hydrocarbon group having 20 to 40 carbon atoms and $R^2$ is hydrogen, i.e., 3-alkylsalicylate is adjusted to be 40 percent by mol or more. The component ratio of 3-alkylsalicylate is preferably 50 percent by mol or more and more preferably 55 percent by mol or more with the objective of further enhanced anti-wear properties and excellent oil solubility. Influences of water to anti-oxidation properties can be lessen by making the component ratio of 3-alkylsalicylate 80 percent by mol or more.

In requirement (IV), it is necessary that the component ratio of a salicylate having one hydrocarbon group having 10 to 19 carbon atoms is 85 percent by mol or more wherein the component ratio of a salicylate represented by formula (1) wherein $R^1$ is a hydrocarbon group having 10 to 19 carbon atoms and $R^2$ is hydrogen is adjusted to be 55 percent by mol or more.

The hydrocarbon group having 10 to 19 carbon atoms in requirement (IV) is preferably a secondary alkyl group and particularly preferably a secondary alkyl group having 14 to 18 carbon atoms with the objective of less influences of water to the anti-oxidation properties of the resulting composition.

The secondary alkyl group is preferably a secondary alkyl group, derived from polymers or copolymers, of ethylene, propylene, or butylene.

No particular limitation is imposed on the method for producing a salicylate fulfilling requirement (IV) The salicylate may be obtained using any of known methods for producing monoalkylsalicylates such that the component ratio thereof is adjusted to be 85 percent by mol or more. The component ratio of the 3-alkylsalicylate in the monoalkylsalicylate may be made 55 percent by mol or more by the following method. First of all, a phenol as the starting material is alkylated selectively at the ortho-position thereof using the equivalent amount of an olefin having 10 to 19 carbon atoms and then carboxylated with carbon dioxide gas; salicylic acid is alkylated selectively at the 3-position thereof using the above olefin; 3-alkylsalicylic acid is selectively isolated or concentrated from a mixture containing monoalkylsalicylic acid as the main component; or such highly concentrated 3-alkylsalicylic acid is added additionally to a monoalkylsalicylic acid mixture such that the component ratio is made 55 percent by mol or more. Thereafter, any of these compounds is reacted with a metal base such as an alkali metal or alkaline earth metal oxide or hydroxide or is once converted to an alkali metal salt such as sodium salt or potassium salt and then substituted with an alkaline earth metal salt thereby obtaining a salicylate fulfilling requirement (IV).

The salicylate thus obtained usually contains 4-alkylsalicylates, 5-alkylsalicylates, 3,5-dialkylsalicylates, 5-alkyl 4-hydroxyisophthalates as by-products, other than 3-alkylsalicylate. The total component ratio of the monoalkylsalicylate in the salicylate is 85 percent by mol or more, preferably 90 percent by mol or more, and most preferably 100 percent by mol but may be 96 percent by mol or less in view of the production cost. The component ratio of the 3-alkylsalicylate in the monoalkylsalicylate is 55 percent by mol or more, preferably 60 percent by mol or more, more preferably 80 percent by mol or more, and most preferably 100 percent by mol but may be 96 percent by mol or less in view of the production cost. A lubricating oil composition with more excellent anti-wear properties can be obtained by enhancing the component ratio of the 3-alkylsalicylate.

A composition whose component ratio of the 3-alkylsalicylate is less than 55 percent by mol is not preferred because it may fail to exhibit sufficiently anti-wear properties, anti-scuffing properties for rocker arm pads and anti-wear properties for cams particularly when it is used in an internal combustion engine.

Examples of Component (A) of the present invention also include basic salts obtained by heating the above-described alkali metal or alkaline earth metal salicylates (neutral salts) with an excess amount of an alkali metal or alkaline earth metal salt or an alkali metal or alkaline earth metal base (alkali metal or alkaline earth metal hydroxide or oxide) in the presence of water; and overbased salts obtained by reacting these neutral salts with a base such as an alkali metal or alkaline earth metal hydroxide in the presence of carbon dioxide gas, boric acid or borate.

These reactions are generally carried out in a solvent (aliphatic hydrocarbon solvents such as hexane, aromatic hydrocarbon solvents such as xylene, and light lubricating base oil). It is preferred to use compounds whose metal content is within the range of 1.0 to 20 percent by mass and preferably 2.0 to 16 percent by mass.

In the present invention, the base number of Component (A) is usually from 0 to 500 mgKOH/g and preferably 20 to 450 mgKOH/g. Component (A) may be a mixture of one or more types of those whose base number is within these ranges. The term "base number" used herein denotes a base number measured by the perchloric acid potentiometric titration method in accordance with section 7 of JIS K2501 "Petroleum products and lubricants-Determination of neutralization number".

No particular limitation is imposed on the metal ratio of Component (A). Generally, one or more types of those with a metal ratio of 20 or less may be used in the form of a mixture. It is particularly preferred to use a salicylate whose metal ratio is 5 or less, preferably 3 or less, more preferably 2.3 or less, and particularly preferably 1.5 or less with the objective of excellent oxidation stability, high temperature detergency, and low friction properties. When a monoalkylsalicylate with a metal ratio of 5 or more and an alkyl group having fewer than 20 carbon atoms is used, the resulting composition may not exhibit anti-scuffing properties for rocker arm pads and anti-wear properties for cams. Therefore, Component (A) whose metal ratio is within the above range is extremely useful. The term "metal ratio" used herein is represented by "valence of metal element x metal element content (mol %)/soap group content (mol %) in a salicylate-based detergent" wherein the metal element is calcium, magnesium, or the like and the soap group is a salicylic acid group, or the like.

In the present invention, the upper limit content of Component (A) is 5 percent by mass or less, preferably 1 percent by mass or less, more preferably 0.4 percent by mass or less in terms of metal based on the total mass of the composition. Furthermore, in order to decrease the sulfated ash content of a composition to 1.0 percent by mass or less, the content of Component (A) is preferably 0.3 percent by mass or less. When the lubricating oil composition of the present invention is used for an internal combustion engine equipped with an exhaust-gas after-treatment device, the content of Component (A) is 0.2 percent by mass or less, preferably 0.15 percent by mass or less, and more preferably 0.10 percent by mass or less in terms of metal so as to avoid harmful influences on the device thereby obtaining a lubricating oil composition whose sulfated ash content is 0.5 percent by mass or less. The lower limit content of Component (A) is 0.005 percent by mass or more, preferably 0.01 percent by mass or more, more preferably 0.02 percent by mass or more, and particularly preferably 0.05 percent by mass or more in terms of metal based on the total mass of the composition. Component (A) exceeding the above-described upper limit, particularly exceeding 0.4 percent by mass in terms of metal increase the sulfated ash content of the composition and may adversely affect the exhaust-gas after treatment device of an internal combustion engine when the composition is used therefor. Component (A) of less than the above-described lower limit can not exhibit its basic performance characteristics as a metallic detergent, resulting in a lubricating oil composition which fails to exhibit high temperature detergency and long drain properties such as oxidation stability and base number retention properties. The sulfated ash content is a value measured by a method described by "Testing Methods for Sulfated Ash" stipulated in JIS K 2272 5. and mainly results from metal-containing additives.

Components (B) of the present invention are phosphorus-containing anti-wear agents. No particular limitation is imposed on such anti-wear agents as long as they contain phosphorus in their molecules.

Component (B) is preferably at least one type of compound selected from the group consisting of phosphorus compounds represented by formulas (2) and (3), and metal salts and amine salts thereof:

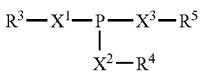

(2)

wherein $X^1$, $X^2$, and $X^3$ are each independently oxygen or sulfur and $R^3$, $R^4$, and $R^5$ are each independently hydrogen or a hydrocarbon group having 1 to 30 carbon atoms; and

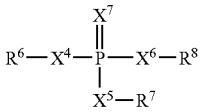

(3)

wherein $X^4$, $X^5$, $X^6$, and $X^7$ are each independently oxygen or sulfur and $R^6$, $R^7$, and $R^6$ are each independently hydrogen or a hydrocarbon groups having 1 to 30 carbon atoms.

Examples of the hydrocarbon groups having 1 to 30 carbon atoms for $R^3$ to $R^8$ include alkyl, cycloalkyl, alkenyl, alkyl-substituted cycloalkyl, aryl, alkyl-substituted aryl, and arylalkyl groups.

Examples of the alkyl group include straight-chain or branched alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups.

Examples of the cycloalkyl group include those having 5 to 7 carbon atoms, such as cyclopentyl, cyclohexyl, and cycloheptyl groups. Examples of the alkylcycloalkyl groups include those having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups, of which the alkyl groups may bond to any position of the cycloalkyl groups.

Examples of the alkenyl group include straight-chain or branched alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, and octadecenyl groups, the position of which the double bonds may vary.

Examples of the aryl group include phenyl and naphtyl groups. Examples of the alkylaryl group include those having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups, of which the alkyl groups may be straight-chain or branched and may bond to any position of the aryl groups.

Examples of the arylalkyl groups include those having 7 to 12 carbon atoms, such as benzyl, phenylethyl, phenylpropyl, phenylbutyl, phenylpentyl, and phenylhexyl groups, of which the alkyl groups may be straight-chain or branched.

Hydrocarbon groups having 1 to 30 carbon atoms for $R^3$ to $R^8$ are preferably alkyl groups having 1 to 30 carbon atoms or aryl groups having 6 to 24 carbon atoms, more preferably alkyl groups having 3 to 18 carbon atoms, and further more preferably alkyl groups having 4 to 12 carbon atoms.

Examples of phosphorus compounds represented by formula (2) include phosphorous acid; monothiophosphorus acid; dithiophosphorus acid; trithiophosphorus acid; phosphorus acid monoesters, monothiophosphorus acid monoesters, dithiophosphorus acid monoesters, and trithiophosphorus acid monoesters, each having one of the above-described hydrocarbon groups having 1 to 30 carbon atoms; phosphorus acid diesters, monothiophosphorus acid diesters, dithiophosphorus acid diesters, and trithiophosphorus acid diesters, each having two of the above-described hydrocarbon groups having 1 to 30 carbon atoms; phosphorus acid triesters, monothiophosphorus acid triesters, dithiophosphorus acid triesters, and trithiophosphorus acid triesters, each having three of the above-described hydrocarbon groups having 1 to 30 carbon atoms; and mixtures thereof.

In the present invention, preferably two or more and particularly preferably all of $X^1$ to $X^3$ in formula (2) are oxygen with the objective of further enhancement of high temperature detergency and long drain properties such as oxidation stability and base number retention properties.

Examples of phosphorus compounds represented by formula (3) include phosphoric acid; monothiophosphoric acid; dithiophosphoric acid; trithiophosphoric acid; tetrathiophosphoric acid; phosphoric acid monoesters, monothiophosphoric acid monoesters, dithiophosphoric acid monoesters, trithiophosphoric acid monoesters, and tetrathiophosphoric acid monoesters, each having one of the above-described hydrocarbon groups having 1 to 30 carbon atoms; phosphoric acid diesters, monothiophosphoric acid diesters, dithiophosphoric acid diesters, trithiophosphoric acid diesters, and tetrathiophosphoric acid diesters, each having two of the above-described hydrocarbon groups having 1 to 30 carbon atoms; phosphoric acid triesters, monothiophosphoric acid triesters, dithiophosphoric acid triesters, trithiophosphoric acid triesters, and tetrathiophosphoric acid triesters, each having three of the above-described hydrocarbon groups having 1 to 30 carbon atoms; and mixtures thereof.

In the present invention, preferably two or more, more preferably three or more, and particularly preferably all of $X^4$ to $X^7$ in formula (3) are oxygen with the objective of further enhancement of high temperature detergency and long drain properties such as oxidation stability and base number retention properties.

Examples of salts of phosphorus compounds represented by formulas (2) and (3) include salts obtained by allowing a metal base such as a metal oxide, a metal hydroxide, a metal carbonate and a metal chloride or a nitrogen-containing compound such as ammonia and an amine compound having in its molecules only a hydrocarbon group having 1 to 30 carbon atoms or a hydroxyl group-containing hydrocarbon group having 1 to 30 carbon atoms to react with a phosphorus compound so as to neutralize part or whole of the remaining acid hydrogen.

Specific examples of the metals of the above-mentioned metal bases include alkali metals such as lithium, sodium, potassium, and cesium, alkaline earth metals such as calcium, magnesium, and barium, and heavy metals such as zinc, copper, iron, lead, nickel, silver, manganese, and molybdenum. Among these metals, preferred are alkaline earth metals such as magnesium and calcium, and zinc.

The above-described metal salts of the phosphorus compounds vary in structure depending on the valence of metals and the number of OH or SH group of the phosphorus compounds. Therefore, no particular limitation is imposed on the structure of the metal salts of the phosphorus compounds. For example, when 1 mol of zinc oxide is reacted with 2 mol of a phosphoric acid diester (with one OH group), it is assumed that a compound with a structure represented by the formula below is obtained as the main component but polymerized molecules may also exist:

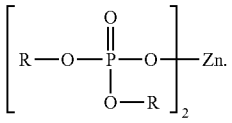

For another example, when 1 mol of zinc oxide is reacted with 1 mol of a phosphoric acid monoester (with two OH groups), it is assumed that a compound with a structure represented by the formula below is obtained as the main component but polymerized molecules may also exist:

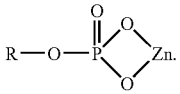

Specific examples of the nitrogen-containing compound include ammonia, monoamines, diamines, and polyamines. More specific examples include alkylamines having a straight-chain or branched alkyl group having 1 to 30 carbon atoms, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenylamines having a straight-chain or branched alkenyl group having 2 to 30 carbon atoms, such as ethenylamine, propenylamine, butenylamine, octenylamine, and oleylamine; alkanolamines having a straight-chain or branched alkanol group having 1 to 30 carbon atoms, such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine, and propanolbutanolamine; alkylenediamines having an alkylene group having 1 to 30 carbon atoms, such as methylenediamine, ethylenediamine, propylenediamine, and butylenediamine; polyamines such as diethylenetriamine, triethylenetetramine, tetraethylenepentamine, and pentaethylenehexamine; heterocyclic compounds such as those having an alkyl or alkenyl group having 8 to 20 carbon atoms bonded to the above-exemplified monoamines, diamines and polyamines, specifically undecyldiethylamine, undecyldiethanolamine, dodecyldipropanolamine, oleyldiethanolamine, oleylpropylenediamine, and stearyltetraethylenepentamine and N-hydroxyethyloleylimidazoline; alkyleneoxide adducts thereof; and mixtures thereof.

Among these nitrogen-containing compounds, preferred examples include aliphatic amines having an alkyl or alkenyl group having 10 to 20 carbon atoms, which may be straight-chain or branched, such as decylamine, dodecylamine, tridecylamine, heptadecylamine, octadecylamine, oleylamine, and stearylamine.

Component (B) is preferably at least one type of compound selected from the group consisting of metal salts of phosphorus compounds represented by formula (2) wherein all of $X^1$, $X^2$, and $X^3$ are oxygen and those of phosphorus compounds represented by formula (3) wherein all of $X^4$, $X^5$, $X^6$, and $X^7$ are oxygen with the objective of excellent long drain properties such as oxidation stability and high temperature detergency and low-friction properties.

Component (B) is more preferably a phosphorus compound represented by formula (3) wherein all of $X^4$, $X^5$, $X^6$, and $X^7$ are oxygen and $R^6$, $R^7$, and $R^8$ are each independently a hydrocarbon group having 1 to 30 carbon atoms with the objective of excellent long drain properties such as oxidation stability and high temperature detergency, low-friction properties and decreased ash content.

Component (B) is further more preferably a zinc salt of a phosphorus compound represented by formula (3) wherein two of $X^4$, $X^5$, $X^6$, and $X^7$ are oxygen with the objective of excellent anti-wear properties and a possibility to decrease the phosphorus content.

The foregoing becomes apparent by way of referring to the above-mentioned patent applications by the inventor of the present invention.

Among Components (B) described above, preferred are salts of phosphorus acid diesters having two alkyl or aryl groups having 3 to 18 carbon atoms and zinc or calcium; phosphorus acid triesters having three alkyl or aryl groups having 3 to 18 carbon atoms, preferably three alkyl groups having 6 to 12 carbon atoms; salts of phosphoric acid monoesters having one alkyl or aryl group having 3 to 18 carbon atoms and zinc or calcium; salts of phosphoric acid diesters having two alkyl or aryl group having 3 to 18 carbon atoms and zinc or calcium; and phosphoric acid triesters having three alkyl or aryl groups having 3 to 18 carbon atoms, preferably three alkyl groups having 6 to 12 carbon atoms.

One or more types of compound among Components (B) may be arbitrarily blended.

When a salt of a dithiophosphorus acid diester having two alkyl or aryl groups having 3 to 18 carbon atoms and zinc is used, the content of the salt can be further decreased to 0.08 percent by mass or less, and further to 0.05 percent by mass or less, in terms of phosphorus based on the total mass of the composition because the salt can maintain anti-wear properties for the valve train of an internal combustion engine. However, it is most preferred to use a phosphorus-containing anti-wear agent containing no sulfur in the molecules because it can further enhance various characteristic performances such as oxidation stability, high temperature detergency, and low friction properties.

The content of Component (B) in the lubricating oil composition of the present invention is 0.005 percent by mass or more, preferably 0.01 percent by mass or more and particularly preferably 0.02 percent by mass or more, and 0.2 percent by mass or less, preferably 0.1 percent by mass or less and more preferably 0.08 percent by mass or less, in terms of phosphorus based on the total mass of the composition. Component (B) of less than 0.005 percent by mass in terms of phosphorus has no effect on anti-wear properties, while Component (B) of more than 0.2 percent by mass in terms of phosphorus may adversely affect an exhaust-gas after-treatment device.

The lubricating oil composition of the present invention has excellent anti-wear properties and can exhibit low-friction properties, high temperature detergency and long drain properties such as base number retention properties and oxidation stability but may contain at least one type selected from the group consisting of (C) ashless dispersants and (D) anti-oxidants for further improving the characteristic performances of the composition.

Component (C), i.e., ashless dispersants may be any of those used in lubricating oils, such as nitrogen-containing compounds having at least one straight-chain or branched alkyl or alkenyl group having 40 to 400 carbon atoms in the molecules and derivatives thereof, and modified products of alkenyl succinimides. Any one or more of these compounds may be blended.

The carbon number of the alkyl or alkenyl group is preferably 40 to 400 and preferably 60 to 350. An alkyl or alkenyl group having fewer than 40 carbon atoms would deteriorate the solubility of the compound in a lubricating base oil, while an alkyl or alkenyl group having more than 400 carbon atoms would deteriorate the low-temperature fluidity of the resulting lubricating oil composition. The alkyl or alkenyl group may be straight-chain or branched but is preferably a branched alkyl or alkenyl group derived from an oligomer of an olefin such as propylene, 1-butene, and isobutylene or from a cooligomer of ethylene and propylene.

Specific examples of Component (C) include the following compounds one or more of which may be used:

(C-1) succinimides having in their molecules at least one alkyl or alkenyl group having 40 to 400 carbon atoms and derivatives thereof;

(C-2) benzylamines having in their molecules at least one alkyl or alkenyl group having 40 to 400 carbon atoms and derivatives thereof; and (C-3) polyamines having in their molecules at least one alkyl or alkenyl group having 40 to 400 carbon atoms and derivatives thereof.

Specific examples of (C-1) succinimides include compounds represented by formulas (4) and (5):

(4)

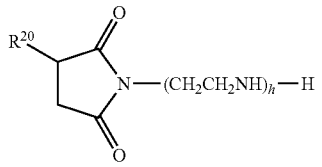

wherein $R^{20}$ is an alkyl or alkenyl group having 40 to 400 and preferably 60 to 350, and h is an integer from 1 to 5, preferably 2 to 4; and (5)

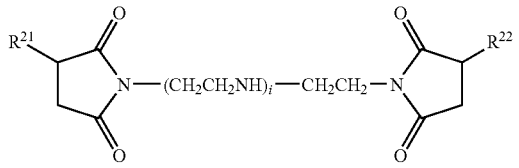

wherein $R^{21}$ and $R^{22}$ are each independently an alkyl or alkenyl group having 40 to 400, preferably 60 to 350 carbon atoms, and particularly preferably a polybutenyl group, and i is an integer from 0 to 4, preferably 1 to 3.

Succinimides include mono-type succinimides wherein a succinic anhydride is added to one end of a polyamine as represented by formula (4) and bis-type succinimides wherein a succinic anhydride is added to both ends of a polyamine as represented by formula (5). The lubricating oil composition may contain either type of the succinimides or mixtures thereof.

No particular limitation is imposed on the method of producing these succinimides. For example, there may be used a method wherein an alkyl or alkenyl succinimide obtained by reacting a compound having an alkyl or alkenyl group having 40 to 400 carbon atoms with maleic anhydride at a temperature of 100 to 200° C. is reacted with a polyamine such as diethylene triamine, triethylene tetramine, tetraethylene pentamine or pentaethylene hexamine.

Specific examples of (C-2) benzylamines include compounds represented by formula (6):

(6)

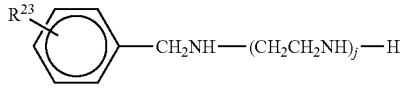

wherein $R^{23}$ is an alkyl or alkenyl group having 40 to 400 and preferably 60 to 350 carbon atoms, and j is an integer from 1 to 5, preferably 2 to 4.

Although no particular limitation is imposed on the method for producing the benzylamines, they may be obtained by reacting a polyolefin such as a propylene oligomer, polybutene, or ethylene-α-olefin copolymer with a phenol so as to obtain an alkylphenol and then subjecting the alkylphenol to Mannich reaction with formaldehyde and a polyamine such as diethylenetriamine, triethylenetetramine, tetraethylenepentamine, or pentaethylenehexamine.

Specific examples of (C-3) polyamines include compounds represented by formula (7):

$$R^{24}—NH—(CH_2CH_2NH)_k—H \quad (7)$$

wherein $R^{24}$ is an alkyl or alkenyl group having 40 to 400 and preferably 60 to 350, and k is an integer from 1 to 5 and preferably 2 to 4.

No particular limitation is imposed on the method for producing the polyamines. For example, the polyamines may be produced by chlorinating a polyolefin such as a propylene oligomer, polybutene, or ethylene-α-olefin copolymer and reacting the chlorinated polyolefin with ammonia or a polyamine such as ethylenediamine, diethylenetriamine, triethylenetetramine, tetraethylenepentamine, or pentaethylenehexamine.

Specific examples of the derivatives of the nitrogen-containing compounds exemplified as an example of Component (C) include acid-modified compounds obtained by allowing any of the above-described nitrogen-containing compounds to react with a monocarboxylic acid having 1 to 30 carbon atoms, such as fatty acid; a polycarboxylic acid having 2 to 30 carbon atoms, such as oxalic acid, phthalic acid, trimellitic acid, and pyromellitic acid; or a hydroxy (poly) alkylenecarbonate so as to neutralize or amidize the part or whole of the remaining amino and/or imino groups; boron-modified compounds obtained by allowing any of the above-described nitrogen-containing compounds to react with boric acid so as to neutralize or amidize the part or whole of the remaining amino and/or imino groups; phosphoric acid-modified compounds obtained by allowing any of the above-described nitrogen-containing compounds to react with phosphoric acid so as to neutralize or amidize the part or whole of the remaining amino and/or imino groups; sulfur-modified compounds obtained by allowing any of the above-described nitrogen-containing compounds to react with a sulfuric compound; and modified products obtained by a combination of two or more selected from the acid modification, boron modification, phosphoric acid modification and sulfur modification, of the above-described nitrogen-containing compounds. Among these derivatives, boric acid-modified compounds of alkenylsuccinimides are excellent in heat resistance, anti-oxidation properties and anti-wear properties and thus effective for enhancing the base number retention properties, high temperature detergency and anti-wear properties of the resulting lubricating oil composition.

When the lubricating oil composition of the present invention contains Component (C), the content thereof is from 0.01 to 20 percent by mass and preferably 0.1 to 10 percent by mass based on the total mass of the composition. Component (C) of less than 0.01 percent by mass is less effective in high temperature detergency, while Component (C) of more than 20 percent by mass deteriorates extremely the low temperature fluidity of the resulting lubricating oil composition.

Component (D), i.e., anti-oxidants may be any of phenol-based anti-oxidants, amine-based anti-oxidants, and metal-based anti-oxidants as long as they are generally used in lubricating oils. Addition of an anti-oxidant can enhance the anti-oxidation properties of a lubricating oil composition and thus can enhance the base number retention properties and high temperature detergency thereof.

Examples of the phenol-based anti-oxidants include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3-(3,5-di-tert-butyl-4-hydroxyphenyl) propionate, pentaerythrityl-tetraquis[3-(3,5-di-tert-butyl-4-hydroxyphenyl)propionate], octyl-3-(3,5-di-tert-butyl-4-hydroxyphenyl) propionate, octadecyl-3-(3,5-di-tert-butyl-4-hydroxyphenyl) propionate, and 3-methyl-5-tert-butyl-4-hydroxyphenyl-substituted fatty acid esters. Mixtures of two or more of these compounds may be used.

Examples of the amine-based anti-oxidants include phenyl-α-naphtylamines, alkylphenyl-α-naphtylamines, and dialkyldiphenylamine. Two or more of these may be mixed.

The phenol-based anti-oxidant and amine-based anti-oxidant may be blended in combination.

When the lubricating oil composition of the present invention contains Component (D), the content thereof is 5 percent by mass or less, preferably 3 percent by mass or less, and more preferably 2.5 percent by mass or less based on the total mass of the composition. Component (D) of more than 5 percent by mass fails to obtain sufficient anti-oxidation properties as balanced with the content. The content of Component (D) is preferably 0.1 percent by mass or more and preferably 1 percent by mass or more in order to further enhance the high temperature detergency and long drain properties such as oxidation stability and base number retention properties during the process of deterioration of a lubricating oil.

In the case of selecting a compound insoluble or less soluble in a lubricating oil, such as zinc dialkylphosphate which is solid at ordinary temperature, from Components (B), it is particularly preferred with the objective of solubility of Component (B) and shortened production time of the resulting lubricating oil composition that the compound be mixed with and dissolved in or reacted with an amine compound such as Component (C), an amine-based anti-oxidant selected from Components (D), or a mixture thereof in an organic solvent such as hexane, toluene, or decalin at a temperature of 15 to 150° C., preferably 30 to 120° C., and particularly preferably 40 to 90° C. for a period of 10 minutes to 5 hours, preferably 20 minutes to 3 hours, and particularly preferably 30 minutes to one hour and blended with a lubricating oil composition as an oil soluble additive after the solvent is vacuum-distilled (see Japanese Patent Application No. 2002-191089).

In order to further enhance the performance characteristics of the lubricating oil composition of the present invention, it may be blended with any of additives which have been used in lubricating oils, depending on purposes. Examples of such additives include metallic detergents other than Components (A) anti-wear agents other than Component (B), friction modifiers, viscosity index improvers, corrosion inhibitors, rust inhibitors, demulsifiers, metal passivators, anti-foaming agents, and dyes.

Examples of metallic detergents other than Component (A) include alkali metal or alkaline earth metal sulfonates, alkali metal or alkaline earth metal phenates, and alkali metal or alkaline earth metal salicylates other than Component (A), i.e., those having one or more hydrocarbon groups having 10 to 40 carbon atoms. The content of the metallic detergents other than Component (A) is from 0.005 to 5 percent by mass in terms of metal based on the total mass of the composition. However, when the composition is used for an internal combustion engine equipped with an exhaust-gas after-treatment device, the content is preferably 0.4 percent by mass or less in terms of metal and more preferably 0.4 percent by mass or less in the total amount with Component (A).

When an alkali metal or alkaline earth metal salicylate other than Component (A) is used in combination therewith, the component ratio of salicylates having a substituent at least at the 3-position including Component (A) is made preferably 65 percent by mol or more, more preferably 70 percent by mol or more, and particularly preferably 80 percent by mol or more.

Examples of anti-wear agents other than Component (B) include sulfur-containing compounds such as disulfides, olefin sulfides, sulfurized fats and oils, and zinc dithiocarbamate. These anti-wear agents may be blended in an amount of 0.005 to 5 percent by mass to an extent that the total sulfur content of the composition is 0.3 percent by mass or less. However, it is preferred that these anti-wear agents not be blended with the objective of decreased sulfur content and long drain properties.

Friction modifiers may be any of compounds which are usually used as friction modifiers for lubricating oils. Examples of such friction modifiers include molybdenum-based friction modifiers such as molybdenum dithiocarbamates, molybdenum dithiophosphate, molybdenumamine complexes, molybdenum-succinimide complexes, and molybdenum disulfide; and ashless friction modifiers such as amine compounds, fatty acid esters, fatty acid amides, fatty acids, aliphatic alcohols, and aliphatic ethers, having at least one alkyl or alkenyl group having 6 to 30 carbon atoms, and particularly preferably straight-chain alkyl or alkenyl group having 6 to 30 carbon atoms in the molecules. These friction modifiers may be blended in an amount of 0.1 to 5 percent by mass. Sulfur-containing molybdenum complexes may be blended within such a range that the total sulfur content of the composition is 0.3 percent by mass or less. Among these ashless friction modifiers, the use of any of fatty acid amides such as oleic acid amide or fatty acid esters such as glycerin monooleate and sorbitan monooleate can further enhance anti-wear properties and friction decreasing effect, respectively. Therefore, the use of these ashless friction modifiers are particularly preferred because the use thereof result in a composition decreased in sulfur, phosphorus, or ash content equivalently to or more than the compositions used in the Examples of the present invention.

Examples of viscosity index improvers include non-dispersion type viscosity index improvers such as polymers or copolymers of one or more monomers selected from various methacrylates or hydrides thereof; dispersion type viscosity index improvers such as copolymers of various methacrylates further containing nitrogen compounds; non-dispersion- or dispersion-type ethylene-α-olefin copolymers of which the α-olefin may be propylene, 1-butene, or 1-pentene, or the hydrides thereof; polyisobutylenes or hydrides thereof; styrene-diene hydrogenated copolymers; styrene-maleic anhydride ester copolymers; and polyalkylstyrenes.

It is necessary to select the molecular weight of these viscosity index improvers considering the shear stability thereof. Specifically, the number-average molecular weight of non-dispersion or dispersion type polymethacrylates is from 5,000 to 1,000,000 and preferably from 100,000 to 900,000. The number-average molecular weight of polyisobutylenes or hydrides thereof is from 800 to 5,000 and preferably from 1,000 to 4,000. The number-average molecular weight of ethylene-a-olefin copolymers or hydrides thereof is from 800 to 500,000 and preferably from 3,000 to 200,000.

Among these viscosity index improvers, the use of ethylene-α-olefin copolymers or hydrides thereof is contributive to the production of a lubricating oil composition which is particularly excellent in shear stability. One or more compounds selected from the above-described viscosity index improvers may be blended in an arbitrary amount. The content of the viscosity index improver is generally from 0.1 to 20 percent by mass, based on the total mass of the composition.

Examples of corrosion inhibitors include benzotriazole-, tolyltriazole-, thiadiazole-, and imidazole-based compounds.

Examples of rust inhibitors include petroleum sulfonates, alkylbenzene sulfonates, dinonylnaphthalene sulfonates, alkenylsuccinic acid esters, and polyhydric alcohol esters.

Examples of demulsifiers include polyalkylene glycol-based non-ionic surfactants such as polyoxyethylenealkyl ethers, polyoxyethylenealkylphenyl ethers, and polyoxyethylenealkylnaphthyl ethers.

Examples of metal passivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of anti-foaming agents include silicone, fluorosilicone, and fluoroalkyl ethers.

When these additives are blended with the lubricating oil composition of the present invention, the content of each of the corrosion inhibitor, rust inhibitor, and demulsifier is selected from 0.005 to 5 percent by mass based on the total mass of the composition. The content of the metal passivator is selected from 0.005 to 1 percent by mass, while the content of the anti-foaming agent is selected from 0.0005 to 1 percent by mass.

The lubricating oil composition of the present invention is a lubricating oil composition with excellent anti-wear properties, whose sulfur content is 0.3 percent by mass or less and can be rendered a low sulfur lubricating oil composition with excellent anti-wear properties, whose sulfur content can be decreased to 0.2 percent by mass or less, preferably 0.1 percent by mass or less, and more preferably 0.05 percent by mass or less, by selecting properly a lubricating base oil, Components (B), and various additives. The present invention can also provide a lubricating oil composition containing sulfur in an amount of 0.01 percent by mass or less or even 0.005 percent by mass or less or substantially no sulfur.

The sulfated ash content of the lubricating oil composition of the present invention can be decreased to 1.0 percent by mass or less, 0.8 percent by mass or less, further 0.6 percent by mass or less, and particularly 0.5 percent by mass or less by adjusting the content of Component (A) or (B) or other metal-containing additives.

The lubricating oil composition of the present invention is a low sulfur lubricating oil composition which is excellent in not only anti-wear properties but also low friction properties, long drain properties (oxidation stability, base number retention properties) and high temperature detergency and thus can be used preferably for internal combustion engines such as gasoline engines, diesel engines, and gas engines, of motorcycles, automobiles, power generators, and ships. The lubricating oil composition can be suitably used for an internal combustion engine equipped with an exhaust-gas after treatment device by decreasing the sulfur, phosphorus and ash contents. Furthermore, the lubricating oil composition can be used particularly suitably for internal combustion engines, particularly gasoline engines and gas engines, using a low sulfur fuel such as gasoline, gas oil, or kerosene, each of whose sulfur content is 50 ppm by mass or less, preferably 30 ppm by mass or less, and particularly preferably 10 ppm by mass or less, LPG, natural gas, or substantially sulfur-free fuels such as hydrogen, dimethylether, alcohols, and GTL (Gas to Liquid).

Furthermore, the lubricating oil composition can be used suitably as lubricants required to have any of the above-described characteristic performances, such as those for driving systems of automatic or manual transmissions, greases, wet brake oils, hydraulic oils, turbine oils, compressor oils, bearing oils, refrigerating oils, or the like.

EFFECTS OF THE INVENTION

The lubricating oil composition of the present invention can exhibit extremely excellent anti-wear properties and can achieve the low contents of sulfur, ash, and phosphorus as well as low friction properties and excellent long drain properties. Therefore, the lubricating oil composition of the present invention can be used not only as a lubricating oil for internal combustion engine but also as those required to have these properties, such as lubricating oils for automatic or manual transmission driving mechanisms, greases, wet brake oils, hydraulic oils, turbine oils, compressor oils, bearing oils, refrigerating oils, or the like.

BEST MODES FOR CARRYING OUT THE INVENTION

Hereinafter, the present invention will be described in more details by way of the following examples and comparative examples, which should not be construed as limiting the scope of the invention.

EXAMPLES 1 to 6, and COMPARATIVE EXAMPLES 1 and 2

There were prepared lubricating oil compositions containing salicylate fulfilling requirement (I) (Examples 1 to 6) and those for comparison (Comparative Examples 1 and 2), as shown in Table 1. The following performance evaluation test was conducted for the resulting compositions.

(1) Valve Train Wear Test

A valve train wear test was conducted in compliance with JASO M 328-95 so as to measure the rocker arm pad scuffing area and the wear of the rocker arm and cams after the lapse of 100 hours. The results are set forth in Table 1. A gasoline whose sulfur content is 10 ppm by mass or less was used as a test fuel.

As apparent from the results shown in Table 1, the compositions of Comparative Examples 1 and 2 containing a monoalkylsalicylate having one alkyl group having 10 to 19 carbon atoms had excellent anti-wear properties for rocker arms but was poor in anti-scuffing properties for rocker arm pads and anti-wear properties for cams.

On the other hand, the lubricating oil compositions of Examples 1 to 6 are low sulfur lubricating oil compositions each of whose total sulfur content is 0.3 percent by mass or less. They had extremely excellent anti-wear properties (anti-scuffing properties for rocker arm pads and anti-wear properties for rocker arms and cams) even though the total sulfur content and the phosphorus content were decreased to 0.01 percent by mass or less and 0.08 percent by mass or less, respectively. Even in the case where the sulfated ash content of the compositions was 0.5 percent by mass or less (Examples 1, 2, 4, 5 and 6), they exhibited excellent performance characteristics. The compositions containing Component (A) having a secondary alkyl group having 10 to 40 carbon atoms at the 3-position and a methyl group at the 5-position (Examples 2, 3 and 5) were more excellent in anti-wear properties. Furthermore, in the case where ¼ of the monoalkylsalicylate of the composition of Comparative Example 1 was substituted with Component (A) of the present invention (Example 6), the component ratio of Component (A) in the calcium salicylate of the composition is 25 percent by mol, and thus the total component ratio of the salicylate having a substituent at least at the 3-position, including Component (A) was 70 percent by mol. However, the composition was significantly improved in anti-wear properties. It is assumed that this is because the salicylate having a substituent at least at the 3-position, particularly Component (A) is less inhibitive in the anti-wear properties of Component (B).

In the case of using zinc dithiophosphate as Component (B), the resulting composition even containing the salicylate used in Comparative Example 2 has sufficient anti-wear properties for valve trains (see Japanese Patent Application No. 2002-015351, the composition of Comparative Example 3, phosphorus content: 0.11 percent by mass, rocker arm scuffing area: 2.8 percent, rocker arm wear: 2.4 μm, and cam wear: 2.3 μm). Therefore, it is found that zinc dithiophosphate can maintain anti-wear properties. However, the compositions of Examples 1 to 5 containing Component (A) and zinc phosphate in combination exhibited more excellent anti-wear properties than the composition containing the salicylate of Comparative Example 2 and zinc dithiophosphate. Therefore, it is apparent that in the case of using Component (A) and sulfur- and phosphorus-containing anti-wear agent such as zinc dithiophosphate, in the present invention, the resulting composition is more excellent in anti-wear properties than those in Examples of the present invention. It is thus assumed that it is possible to obtain a composition decreased in phosphorus content to 0.05 percent by mass or less, total sulfur content to 0.1 percent by mass or less, and sulfated ash content to 0.5 percent by mass or less and having excellent anti-wear properties.

Furthermore, even in the case of using other Component (B) defined by the present invention, such as metal-free phosphoric acid triesters as long as used in combination with Component (A), it is possible to significantly improve the anti-wear properties and decrease the ash of the resulting composition, compared with the case of using the salicylates of Comparative Examples 1 and 2, because Component (A) is less inhibitive in the anti-wear properties of Component (B).

EXAMPLE 7 and COMPARATIVE EXAMPLE 3

There were prepared a lubricating oil composition containing a salicylate fulfilling requirement (II) (Example 7) and a lubricating oil composition for comparison (Comparative Example 3), as shown in Table 2. The resulting compositions were subjected to the same performance evaluation test as that in Example 1. The results are also shown in Table 2.

As apparent from the results shown in Table 2, the composition of Comparative Example 3 containing a monoalkylsalicylate having one alkyl group having 10 to 19 carbon atoms had excellent anti-wear properties for rocker arms but was poor in anti-scuffing properties for rocker arm pads and anti-wear properties for cams.

On the other hand, the lubricating oil composition of Example 7 was a low sulfur lubricating oil composition whose total sulfur content is 0.3 percent by mass or less. It had extremely excellent anti-wear properties (anti-scuffing properties for rocker arms and anti-wear properties for rocker arms and cams) even though the total sulfur content and the phosphorus content were decreased to 0.01 percent by mass or less and 0.08 percent by mass or less, respectively. It is possible to further decrease the sulfated ash content of the composition to 0.5 percent by mass or less. Even in the case of substituting part of the monoalkylsalicylate in the composition of Comparative Example 3 with Component (A) of the present invention such that the component ratio of the 3,5-dialkylsalicylate in the salicylate is 10 percent by mol or more, preferably 20 percent by mol or more, or more preferably the total component ratio of the salicylate having a substituent at least at the 3-position, including Component (A) is preferably 65 percent by mol or more, more preferably 70 percent by mol or more, and particularly preferably 80 percent by mol or more, it was still recognized that the resulting composition was improved in anti-wear properties. It is assumed that this is because the salicylate having a substituent at least at the 3-position, particularly Component (A) is less inhibitive in the anti-wear properties of Component (B).

In the case of using a sulfur- and phosphorus-containing anti-wear agent such as zinc dithiophosphate as Component (B), the resulting composition can exhibit more excellent anti-wear properties than that in Example 7 of the present invention because the anti-wear agent can maintain anti-wear properties, compared with a sulfur-free anti-wear agent. Therefore, it is assumed that it is possible to obtain a composition decreased in phosphorus content to 0.05 percent by mass or less, total sulfur content to 0.1 percent by mass or less, and sulfated ash content to 0.5 percent by mass or less and having excellent anti-wear properties.

Furthermore, even in the case of using other Component (B) defined by the present invention, such as metal-free phosphoric acid triesters as long as used in combination with Component (A), it is possible to significantly improve the anti-wear properties and decrease the ash of the resulting composition, compared with the case using the salicylates of Comparative Example 3, because Component (A) is less inhibitive in the anti-wear properties of Component (B).

EXAMPLES 8 and 9 and COMPARATIVE EXAMPLES 4 and 5

There were prepared lubricating oil compositions containing a salicylate fulfilling requirement (III) (Examples 8 and 9) and lubricating oil compositions for comparison (Comparative Examples 4 and 5), as shown in Table 3. The resulting compositions were subjected to the same performance evaluation test as that in Example 1. The results are also shown in Table 3.

As apparent from the results shown in Table 3, the compositions of Comparative Examples 4 and 5 containing a monoalkylsalicylate having one alkyl group having 10 to 19 carbon atoms had excellent anti-wear properties for rocker arms but was poor in anti-scuffing properties for rocker arm pads and anti-wear properties for cams.

On the other hand, the lubricating oil compositions of Examples 8 and 9 were low sulfur lubricating oil compositions each of whose total sulfur content is 0.3 percent by mass or less. They had extremely excellent anti-wear properties (anti-scuffing properties for rocker arm pads and anti-wear properties for rocker arms and cams) even though the total sulfur content and the phosphorus content were decreased to 0.01 percent by mass or less and 0.08 percent by mass or less, respectively. Particularly, the composition whose sulfated ash content was decreased to 0.5 percent by mass or less, using only Component (A) whose metal ratio was 1.5 or less (Example 8) exhibited extremely excellent anti-wear properties.

Although not shown in Examples, compositions obtained by substituting part of the salicylate of those in Comparative Examples 4 and 5 with Component (A) of the present invention can be improved in anti-wear properties. It is assumed that the salicylate having a high molecular weight hydrocarbon group as a substituent is less inhibitive in the anti-wear properties of Component (B).

In the case of using a sulfur- and phosphorus-containing anti-wear agent such as zinc dithiophosphate as Component (B), the resulting composition can exhibit more excellent anti-wear properties than that in Example 8 of the present invention because the anti-wear agent can maintain anti-wear properties, compared with a sulfur-free anti-wear agent. Therefore, it is thus assumed that it is possible to obtain a composition decreased in phosphorus content to 0.05 percent by mass or less, total sulfur content to 0.1 percent by mass or less, and sulfated ash content to 0.5 percent by mass or less and having excellent anti-wear properties.

Furthermore, even in the case of using other Component (B) defined by the present invention, such as metal-free phosphoric acid triesters as long as used in combination with Component (A), it is possible to significantly improve the anti-wear properties and decrease the ash of the resulting composition, compared with the case using the salicylates of Comparative Examples 4 and 5, because Component (A) is less inhibitive in the anti-wear properties of Component (B).

EXAMPLE 10 and COMPARATIVE EXAMPLE 6

There were prepared a lubricating oil composition containing a salicylate fulfilling requirement (IV) (Example 10) and a lubricating oil composition for comparison (Comparative Example 6), as shown in Table 4. The resulting compositions were subjected to the same performance evaluation test as that in Example 1. The results are also shown in Table 4.

As apparent from the results shown in Table 4, the composition of Comparative Example 6 containing a monoalkylsalicylate having one alkyl group having 10 to 19 carbon atoms (the component ratio of 3-alkylsalicylate: 51 percent by mol) had excellent anti-wear properties for rocker arms but was poor in anti-scuffing properties for rocker arm pads and anti-wear properties for cams.

On the other hand, the composition of the present invention (Example 10) contained a monoalkylsalicylate prepared by adding additionally a pre-isolated 3-alkylsalicylate to the monoalkylsalicylate used in Comparative Example 6 such that the component ratio of the 3-alkylsalicylate was 63 percent by mol and was found to be improved in anti-wear properties particularly for cams to an extent that the cam wear was decreased to half. Therefore, it is apparent that the 3-alkylsalicylate is less inhibitive in the anti-wear properties of Component (B), and extremely excellent anti-wear properties can be achieved by further enhancing the component ratio of the 3-alkylsalicylate, for example, to 80 percent by mol or more. The lubricating oil composition of the present invention was a low sulfur lubricating oil composition whose total sulfur content is 0.3 percent by mass or less. It had extremely excellent anti-wear properties (anti-scuffing properties for rocker arm pads and anti-wear properties for rocker arms and cams) even though the total sulfur content and the phosphorus content were decreased to 0.01 percent by mass or less and 0.08 percent by mass or less, respectively. It is possible to further decrease the sulfated ash content of the composition to 0.5 percent by mass or less.

In the case of using a sulfur- and phosphorus-containing anti-wear agent such as zinc dithiophosphate as Component (B), the resulting composition can exhibit more excellent anti-wear properties than that in Example 10 of the present invention because the anti-wear agent can maintain anti-wear properties, compared with a sulfur-free anti-wear agent. Therefore, it is assumed that it is possible to obtain a composition decreased in phosphorus content to 0.05 percent by mass or less, total sulfur content to 0.1 percent by mass or less, and sulfated ash content to 0.5 percent by mass or less and having excellent anti-wear properties.

Furthermore, even in the case of other Component (B) defined by the present invention, such as metal-free phosphoric acid triesters as long as used in combination with Component (A), it is possible to significantly improve the anti-wear properties and decrease the ash of the resulting composition, compared with those of Comparative Example 6, because Component (A) is less inhibitive in the anti-wear properties of Component (B).

TABLE 1

| | | Example 1 | Example 2 | Example 3 | Example 4 | Example 5 | Example 6 | Comparative Example 1 | Comparative Example 2 |
|---|---|---|---|---|---|---|---|---|---|
| Lubricating base oil[1)] | mass % | balance | balance | balance | balance | balance | balance | balance | balance |
| (A) Calcium salicylate | mass % | 4 | — | — | — | — | — | — | — |
| in terms of metal[2)] | mass % | (0.08) | — | — | — | — | — | — | — |
| (A) Calcium salicylate | mass % | — | 4 | — | — | — | 1 | — | — |
| in terms of metal[3)] | mass % | — | (0.08) | — | — | — | (0.02) | — | — |
| (A) Calcium salicylate | mass % | — | — | 4 | — | — | — | — | — |
| in terms of metal[4)] | mass % | — | — | (0.25) | — | — | — | — | — |
| (A) Calcium salicylate | mass % | — | — | — | 4 | — | — | — | — |
| in terms of metal[5)] | mass % | — | — | — | (0.08) | — | — | — | — |
| (A) Calcium salicylate | mass % | — | — | — | — | 4 | — | — | — |
| in terms of metal[6)] | mass % | — | — | — | — | (0.08) | — | — | — |
| Monoalkylcalcium salicylate | mass % | — | — | — | — | — | 3 | 4 | — |
| in terms of metal[7)] | mass % | — | — | — | — | — | (0.06) | (0.08) | — |
| Monoalkylcalcium salicylate | mass % | — | — | — | — | — | — | — | 4 |
| in terms of metal[8)] | mass % | — | — | — | — | — | — | — | (0.25) |
| (B) Phosphorus compound | mass % | 0.6 | 0.6 | 0.6 | 0.6 | 0.6 | 0.6 | 0.6 | 0.6 |
| in terms of phosphorus[9)] | mass % | (0.078) | (0.078) | (0.078) | (0.078) | (0.078) | (0.078) | (0.078) | (0.078) |
| (C) Ashless dispersant[10)] | mass % | 5 | 5 | 5 | 5 | 5 | 5 | 5 | 5 |
| (D) Anti-oxidant[11)] | mass % | 2 | 2 | 2 | 2 | 2 | 2 | 2 | 2 |
| Viscosity index improver[12)] | mass % | 4 | 4 | 4 | 4 | 4 | 4 | 4 | 4 |
| Demulsifier[13)] | mass % | 0.01 | 0.01 | 0.01 | 0.01 | 0.01 | 0.01 | 0.01 | 0.01 |
| Total sulfur content | mass % | <0.01 | <0.01 | <0.01 | <0.01 | <0.01 | <0.01 | <0.01 | <0.01 |
| Sulfated ash content | mass % | 0.39 | 0.39 | 0.97 | 0.39 | 0.39 | 0.39 | 0.39 | 0.97 |
| JASO valve train wear test | | | | | | | | | |
| Rocker arm scuffing area | % | 1.7 | 1 | 1.1 | 2 | 1 | 10.8 | 77.5 | 74.6 |
| Rocker arm wear | μm | 1.4 | 0.6 | 0 | 0.6 | 0.8 | 2.3 | 5 | 4.7 |
| Cam wear | μm | 1.8 | 1.5 | 1.4 | 1.8 | 0.7 | 1.8 | 31.1 | 39.1 |

[1)]hydrogenated refined mineral oil, total aromatic content: 1.2 mass %, sulfur content: 0.001 mass %, kinematic viscosity at 100° C.: 5.6 $mm^2/s$, viscosity index: 125, NOACK evaporation loss: 8 mass %
[2)]3-methyl-5-alkylcalcium salicylate, alkyl group: secondary C14, C16, C18, metal ratio: 1, Ca content: 2.0 mass %, sulfated ash: 6.8 mass %
[3)]3-alkyl-5-methylcalcium salicylate, alkyl group: secondary C14, C16, C18, metal ratio: 1, Ca content: 2.0 mass %, sulfated ash: 6.8 mass %
[4)]3-alkyl-5-methylcalcium salicylate, alkyl group: secondary C14, C16, C18, metal ratio: 2.7, Ca content: 6.2 mass %, sulfated ash: 21.1 mass %
[5)]3-alkyl-5-t-butylcalcium salicylate, alkyl group: secondary C14, C16, C18, metal ratio: 1, Ca content: 2.0 mass %, sulfated ash: 6.8 mass %
[6)]3-alkyl-5-methylcalcium salicylate, alkyl group: secondary C20, C22, C24, C26, metal ratio: 1, Ca content: 2.0 mass %, sulfated ash: 6.8 mass %
[7)]component ratio of salicylic acid: 3-alkylsalicylic acid 51 mol %; 5-alkylsalicylic acid 35 mol %: 4-alkylsalicylic acid 6 mol %; 3,5-dialkylsalicylic acid 7 mol %, 5-alkyl4-hydroxyisophtalic acid 1 mol %, alkyl group: secondary C14, C16, C18, metal ratio: 1, Ca content: 2.0 mass %, sulfated ash content: 6.8 mass %
[8)]component ratio of salicylic acid: 3-alkylsalicylic acid 51 mol %; 5-alkylsalicylic acid 35 mol %; 4-alkylsalicylic acid 6 mol %; 3,5-dialkylsalicylic acid 7 mol %, 5-alkyl4-hydroxyisophtalic acid 1 mol %, alkyl group: secondary C14, C16, C18, metal ratio: 2.7, Ca content: 6.2 mass %, sulfated ash: 21.1 mass %
[9)]zinc di(n-butyl)phosphate, phosphorus content: 13.2 mass %, sulfur content: 0 mass %, zinc content: 13.0 mass %, sulfated ash content: 19.5 mass %
[10)]polybutenylsuccinimide, number-average molecular weight of polybutenyl group: 1,300
[11)]octyl-3-(3,5-di-tert-butyl-4-hydroxyphenyl)propionate and alkyldiphenyl amine (1:1)
[12)]OCP, weight average molecular weight: 150,000
[13)]polyalkylene glycol based

TABLE 2

| | | Example 7 | Comparative Example 3 |
|---|---|---|---|
| Lubricating base oil[1)] | mass % | balance | balance |
| (A) Dialkylcalcium salicylate | mass % | 4 | — |
| in terms of metal[2)] | mass % | (0.08) | — |
| Monoalkylcalcium salicylate | mass % | — | 4 |
| in terms of metal[3)] | mass % | — | (0.08) |
| (B) Phosphorus compound | mass % | 0.6 | 0.6 |
| in terms of phosphorus[4)] | mass % | (0.078) | (0.078) |
| (C) Ashless dispersant[5)] | mass % | 5 | 5 |
| (D) Anti-oxidant[6)] | mass % | 2 | 2 |
| Viscosity index improver[7)] | mass % | 4 | 4 |
| Demulsifier[8)] | mass % | 0.01 | 0.01 |
| Total sulfur content | mass % | <0.01 | <0.01 |
| Sulfated ash content | mass % | 0.39 | 0.39 |

TABLE 2-continued

| | | Example 7 | Comparative Example 3 |
|---|---|---|---|
| JASO valve train wear test | | | |
| Rocker arm scuffing area | % | 3 | 77.5 |
| Rocker arm wear | μm | 0.8 | 5 |
| Cam wear | μm | 2.3 | 31.1 |

[1)]hydrogenated refined mineral oil, total aromatic content: 1.2 mass %, sulfur content: 0.001 mass %, kinematic viscosity at 100° C.: 5.6 $mm^2/s$, viscosity index: 125, NOACK evaporation loss: 8 mass %
[2)]3,5-dialkylcalcium salicylate, alkyl group: secondary C14, C16, C18, metal ratio: 1, Ca content: 2.0 mass %, sulfated ash: 6.8 mass %

TABLE 2-continued

| | Example 7 | Comparative Example 3 |
|---|---|---|

[3]component ratio of salicylic acid: 3-alkylsalicylic acid 51 mol %; 5-alkylsalicylic acid 35 mol %; 4-alkylsalicylic acid 6 mol %; 3,5-dialkylsalicylic acid 7 mol %, 5-alkyl4-hydroxyisophtalic acid 1 mol %, alkyl group: secondary C14, C16, C18, metal ratio: 1, Ca content: 2.0 mass %, sulfated ash content: 6.8 mass %

[4]zinc di(n-butyl)phosphate, phosphorus content: 13.2 mass %, sulfur content: 0 mass %, zinc content: 13.0 mass %, sulfated ash content: 19.5 mass %

[5]polybutenylsuccinimide, number-average molecular weight of polybutenyl group: 1,300

[6]octyl-3-(3,5-di-tert-butyl-4-hydroxyphenyl)propionate and alkyldiphenyl amine (1:1)

[7]OCP, weight average molecular weight: 150,000

[8]polyalkylene glycol based

TABLE 4

| | | Example 10 | Comparative Example 6 |
|---|---|---|---|
| Lubricating base oil[1] | mass % | balance | balance |
| (A) Calcium salicylate | mass % | 4 | — |
| in terms of metal[2] | mass % | (0.08) | — |
| Calcium salicylate | mass % | — | 4 |
| in terms of metal[3] | mass % | — | (0.08) |
| (B) Phosphorus compound | mass % | 0.6 | 0.6 |
| in terms of phosphorus[4] | mass % | (0.078) | (0.078) |
| (C) Ashless dispersant[5] | mass % | 5 | 5 |
| (D) Anti-oxidant[6] | mass % | 2 | 2 |
| Viscosity index improver[7] | mass % | 4 | 4 |
| Demulsifier[8] | mass % | 0.01 | 0.01 |
| Total sulfur content | mass % | <0.01 | <0.01 |
| Sulfated ash content | mass % | 0.39 | 0.39 |

TABLE 3

| | | Example 8 | Example 9 | Comparative Example 4 | Comparative Example 5 |
|---|---|---|---|---|---|
| Lubricating base oil[1] | mass % | balance | balance | balance | balance |
| (A) Monoalkylcalcium salicylate | mass % | 4 | — | — | — |
| in terms of metal[2] | mass % | (0.08) | — | — | — |
| (A) Monoalkylcalcium salicylate | mass % | — | 3 | — | — |
| in terms of metal[3] | mass % | — | (0.25) | — | — |
| Monoalkylcalcium salicylate | mass % | — | — | 4 | — |
| in terms of metal[4] | mass % | — | — | (0.08) | — |
| Monoalkylcalcium salicylate | mass % | — | — | — | 4 |
| in terms of metal[5] | mass % | — | — | — | (0.25) |
| (B) Phosphorus compound | mass % | 0.6 | 0.6 | 0.6 | 0.6 |
| in terms of phosphorus[6] | mass % | (0.078) | (0.078) | (0.078) | (0.078) |
| (C) Ashless dispersant[7] | mass % | 5 | 5 | 5 | 5 |
| (D) Anti-oxidant[8] | mass % | 2 | 2 | 2 | 2 |
| Viscosity index improver[9] | mass % | 4 | 4 | 4 | 4 |
| Demulsifier[10] | mass % | 0.01 | 0.01 | 0.01 | 0.01 |
| Total sulfur content | mass % | <0.01 | <0.01 | <0.01 | <0.01 |
| Sulfated ash content | mass % | 0.39 | 0.96 | 0.39 | 0.96 |
| JASO valve train wear test | | | | | |
| Rocker arm scuffing area | % | 2 | 13.1 | 77.5 | 74.6 |
| Rocker arm wear | μm | 1.5 | 0 | 5 | 4.7 |
| Cam wear | μm | 2.2 | 12.2 | 31.1 | 39.1 |

[1]hydrogenated refined mineral oil, total aromatic content: 1.2 mass %, sulfur content: 0.001 mass %, kinematic viscosity at 100° C.: 5.6 $mm^2/s$, viscosity index: 125, NOACK evaporation loss: 8 mass %

[2]component ratio of salicylic acid: 3-alkylsalicylic acid 55 mol %; 5-alkylsalicylic acid 34 mol %; 4-alkylsalicylic acid 5 mol %; 3,5-dialkylsalicylic acid 3 mol %, 5-alkyl4-hydroxyisophtalic acid 3 mol %, alkyl group: secondary C20, C22, C24, C26, metal ratio: 1.2, Ca content: 2.0 mass %, sulfated ash content: 6.8 mass %

[3]component ratio of salicylic acid: 3-alkylsalicylic acid 55 mol %; 5-alkylsalicylic acid 34 mol %; 4-alkylsalicylic acid 5 mol %; 3,5-dialkylsalicylic acid 3 mol %, 5-alkyl4-hydroxyisophtalic acid 3 mol %, alkyl group: secondary C20, C22, C24, C26, metal ratio: 4.4, Ca content: 8.3 mass %, sulfated ash content: 28.2 mass %

[4]component ratio of salicylic acid: 3-alkylsalicylic acid 51 mol %; 5-alkylsalicylic acid 35 mol %; 4-alkylsalicylic acid 6 mol %; 3,5-dialkylsalicylic acid 7 mol %, 5-alkyl4-hydroxyisophtalic acid 1 mol %, alkyl group: secondary C14, C16, C18, metal ratio: 1, Ca content: 2.0 mass %, sulfated ash content: 6.8 mass %

[5]component ratio of salicylic acid: 3-alkylsalicylic acid 51 mol %; 5-alkylsalicylic acid 35 mol %; 4-alkylsalicylic acid 6 mol %; 3,5-dialkylsalicylic acid 7 mol %, 5-alkyl4-hydroxyisophtalic acid 1 mol %, alkyl group: secondary C14, C16, C18, metal ratio: 2.7, Ca content: 6.2 mass %, sulfated ash content: 21.1 mass %

[6]zinc di(n-butyl)phosphate, phosphorus content: 13.2 mass %, sulfur content: 0 mass %, zinc content: 13.0 mass %, sulfated ash content: 19.5 mass %

[7]polybutenylsuccinimide, number-average molecular weight of polybutenyl group: 1,300

[8]octyl-3-(3,5-di-tert-butyl-4-hydroxyphenyl)propionate and alkyldiphenyl amine (1:1)

[9]OCP, weight average molecular weight: 150,000

[10]polyalkylene glycol based

TABLE 4-continued

| | | Example 10 | Comparative Example 6 |
|---|---|---|---|
| JASO valve train wear test | | | |
| Rocker arm scuffing area | % | 49.2 | 77.5 |
| Rocker arm wear | μm | 3.2 | 5 |
| Cam wear | μm | 15.1 | 31.1 |

[1]hydrogenated refined mineral oil, total aromatic content: 1.2 mass %, sulfur content: 0.001 mass %, kinematic viscosity at 100° C.: 5.6 $mm^2/s$, viscosity index: 125, NOACK evaporation loss: 8 mass %

[2]component ratio of salicylic acid: 3-alkylsalicylic acid 63 mol %; 5-alkylsalicylic acid 28 mol %; 4-alkylsalicylic acid 4 mol %; 3,5-dialkylsalicylic acid 3 mol %, 5-alkyl4-hydroxyisophtalic acid 2 mol %, alkyl group: secondary C14, C16, C18, metal ratio: 1, Ca content: 2.0 mass %, sulfated ash content: 6.8 mass %

[3]component ratio of salicylic acid: 3-alkylsalicylic acid 51 mol %; 5-alkylsalicylic acid 35 mol %; 4-alkylsalicylic acid 6 mol %; 3,5-dialkylsalicylic acid 7 mol %, 5-alkyl4-hydroxyisophtalic acid 1 mol %, alkyl group: secondary C14, C16, C18, metal ratio: 1, Ca content: 2.0 mass %, sulfated ash content: 6.8 mass %

[4]zinc di(n-butyl)phosphate, phosphorus content: 13.2 mass %, sulfur content: 0 mass %, zinc content: 13.0 mass %, sulfated ash content: 19.5 mass %

[5]polybutenylsuccinimide, number-average molecular weight of polybutenyl group: 1,300

[6]octyl-3-(3,5-di-tert-butyl-4-hydroxyphenyl)propionate and alkyldiphenyl amine (1:1)

[7]OCP, weight average molecular weight: 150,000

[8]polyalkylene glycol based

The invention claimed is:

1. A lubricating oil composition comprising a lubricating base oil, (A) an alkali metal or alkaline earth metal salicylate represented by formula (1) below and/or an overbased or basic salt thereof in an amount of 0.005 to 0.4 percent by mass in terms of metal and (B) a phosphorus-containing anti-wear agent in an amount of 0.005 to 0.2 percent by mass in terms of phosphorus and containing sulfur in a total amount of 0.3 percent by mass or less, based on the total mass of the composition, the salicylate being any of salicylates fulfilling at least one of requirements selected from (I) through (IV) or a mixture of the salicylates:

(1)

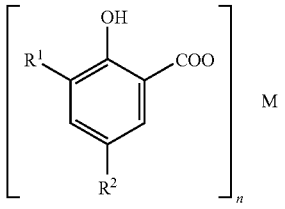

wherein $R^1$ is a hydrocarbon group having 1 to 40 carbon atoms, $R^2$ is hydrogen or a hydrocarbon group having 1 to 40 carbon atoms, which hydrocarbon groups may contain oxygen or nitrogen, M is an alkali metal or alkaline earth metal, and n is an integer of 1 or 2 depending on the valence of the metal;

(I) either one of $R^1$ or $R^2$ in formula (1) is a hydrocarbon group having 1 to 9 carbon atoms and the other is a hydrocarbon group having 10 to 40 carbon atoms, and the difference of carbon number between $R^1$ and $R^2$ is 10 or more;

(II) the component ratio of a salicylate represented by formula (1) wherein $R^1$ and $R^2$ are alkyl or alkenyl groups having 10 to 40 carbon atoms is adjusted to be 10 percent by mol or more;

(III) the component ratio of a salicylate having one hydrocarbon group having 20 to 40 carbon atoms is 85 percent by mol or more wherein the component ratio of a salicylate represented by formula (1) wherein $R^1$ is a secondary alkyl group having 20 to 40 carbon atoms and $R^2$ is hydrogen is adjusted to be 50 percent by mol or more; and (IV) the component ratio of a salicylate having one hydrocarbon group having 10 to 19 carbon atoms is 85 percent by mol or more wherein the component ratio is a salicylate represented by formula (1) wherein $R^1$ is a secondary alkyl group having 10 to 19 carbon atoms and $R^2$ is hydrogen is adjusted to be 55 percent by mol or more, wherein Component (B) is a metal salt of a phosphorus compound of formula (3) wherein all of $X^4$, $X^5$, $X^6$, and $X^7$ are oxygen, and any two of $R^6$, $R^7$, and $R^8$ are hydrocarbon groups having 1 to 30 carbon atoms:

(3)

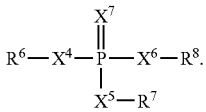

2. The lubricating oil composition according to claim 1 wherein it contains Component (B) in an amount of 0.08 percent by mass or less in terms of phosphorus based on the total mass of the composition.

3. The lubricating oil composition according to claim 1 wherein it contains preferably at least one type of additive selected from the group consisting of (C) ashless dispersants and (D) anti-oxidants.

4. The lubricating oil composition according to claim 1 wherein the total sulfur content of the lubricating base oil is 0.05 percent by mass or less.

5. The lubricating oil composition according to claim 1 wherein it is used for an internal combustion engine.

6. The lubricating oil composition according to claim 5 wherein the sulfated ash content is 1.0 percent by mass or less.

7. The lubricating oil composition according to claim 5 wherein the composition fulfills one or more requirements selected from the group consisting of: (a) the sulfated ash content is 0.5 percent by mass or less, (b) the total sulfur content is 0.05 percent by mass or less, and (c) the phosphorus content is 0.05 percent by mass or less.

8. A method for preventing the valve train of an internal combustion engine from wearing using the lubricating oil composition as defined in claim 1.

* * * * *

UNITED STATES PATENT AND TRADEMARK OFFICE

CERTIFICATE OF CORRECTION

PATENT NO. : 7,625,847 B2
APPLICATION NO. : 11/048573
DATED : December 1, 2009
INVENTOR(S) : Kazuhiro Yagishita It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 616 days.

Signed and Sealed this

Second Day of November, 2010

David J. Kappos

David J. Kappos
*Director of the United States Patent and Trademark Office*